US005771505A

United States Patent [19]

Reynolds

[11] Patent Number: 5,771,505

[45] Date of Patent: Jun. 30, 1998

[54] BATHTUB SAFETY GUARD

[76] Inventor: Joseph R. Reynolds, 5101-281 So. Monterey Hwy., San Jose, Calif. 95111

[21] Appl. No.: 799,377

[22] Filed: Feb. 14, 1997

[51] Int. Cl.[6] ..... A47K 3/14

[52] U.S. Cl. ..... 4/559; 4/514; 49/55; 160/222

[58] Field of Search ..... 4/505, 514, 559; 49/55, 463–465; 160/222, 225

[56] References Cited

U.S. PATENT DOCUMENTS

| | | | |
|---|---|---|---|
| 990,371 | 4/1911 | Minns | 4/514 |
| 1,196,444 | 8/1916 | Ellis | 160/225 |
| 3,000,063 | 9/1961 | Hoog | 49/55 |
| 3,713,179 | 1/1973 | Dubiel | 4/577.1 |
| 3,925,831 | 12/1975 | Perkins | 4/514 |
| 4,492,263 | 1/1985 | Gebhard | 160/222 |
| 4,787,174 | 11/1988 | Brown | 49/55 |
| 5,367,829 | 11/1994 | Crossley et al. | 49/465 |
| 5,423,095 | 6/1995 | Bearer | 4/514 |
| 5,570,543 | 11/1996 | Bishop | 49/465 |
| 5,664,371 | 9/1997 | Berliner | 49/55 |

FOREIGN PATENT DOCUMENTS

| | | | |
|---|---|---|---|
| 2346101 A | 3/1975 | Germany | 4/514 |
| 4024093 A | 1/1992 | Germany | 4/514 |
| 2247618 | 3/1992 | United Kingdom | 4/559 |

*Primary Examiner*—Charles R. Eloshway

[57] ABSTRACT

A new Bathtub Safety Guard for preventing a child from accessing or contacting the spigot or water control knobs provided in a bathtub. The device includes a first gate section and a second gate section slidably attached to the first gate section, wherein the first and second gate sections each have an upper portion and a lower portion whereby the effective combined width of the first arid second gate sections can be varied such that the lower portions fit within the width of a bathtub. The upper portions of the first and second gate sections extend over the sides of the bathtub. The upper portion of the first gate section abuts an enclosure wall provided on the back side of the bathtub. A plurality of suction cups are provided on the edges of the first and second gate sections for releasably attaching the first and second gate sections to the bathtub and the enclosure wall.

18 Claims, 3 Drawing Sheets

FIG. 5
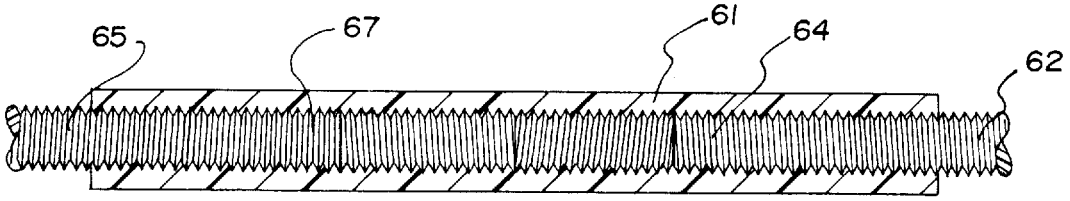
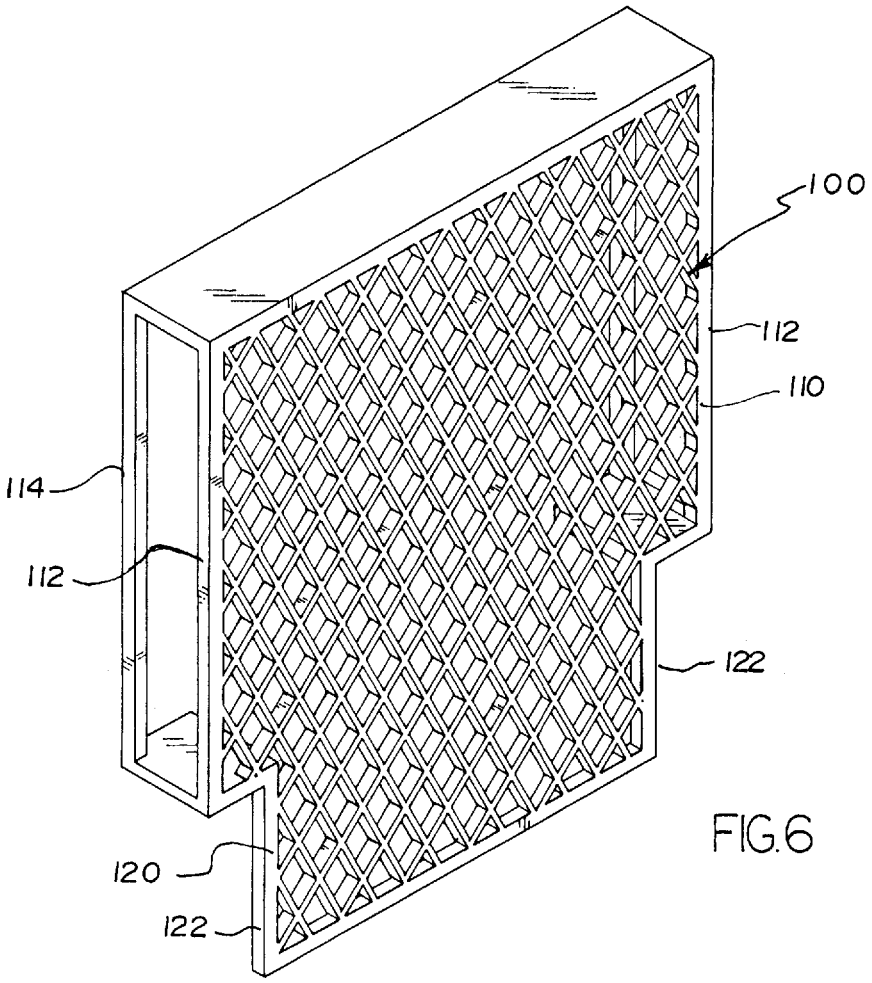
FIG. 6

BATHTUB SAFETY GUARD

BACKGROUND OF THE INVENTION

1. Field of the Invention

The present invention relates to safety guards and more particularly pertains to a new Bathtub Safety Guard for preventing a child from accessing or contacting the spigot or water control knobs provided in a bathtub.

2. Description of the Prior Art

The use of safety guards is known in the prior art. More specifically, safety guards heretofore devised and utilized are known to consist basically of familiar, expected and obvious structural configurations, notwithstanding the myriad of designs encompassed by the crowded prior art which have been developed for the fulfillment of countless objectives and requirements.

Known prior art safety guards include U.S. Pat. No. 3,925,831; U.S. Pat. No. 4,723,587; U.S. Pat. No. 5,249,315; U.S. Pat. No. 5,367,829; U.S. Pat. No. 3,874,005; and U.S. Pat. No. 4,351,073.

While these devices fulfill their respective, particular objectives and requirements, the aforementioned patents do not disclose a new Bathtub Safety Guard. The inventive device includes a first gate section and a second gate section slidably attached to the first gate section, wherein the first and second gate sections each have an upper portion and a lower portion whereby the effective combined width of the first and second gate sections can be varied such that the lower portions fit within the width of a bathtub.

In these respects, the Bathtub Safety Guard according to the present invention substantially departs from the conventional concepts and designs of the prior art, and in so doing provides an apparatus primarily developed for the purpose of preventing a child from accessing or contacting the spigot or water control knobs provided in a bathtub.

SUMMARY OF THE INVENTION

In view of the foregoing disadvantages inherent in the known types of safety guards now present in the prior art, the present invention provides a new Bathtub Safety Guard construction wherein the same can be utilized for preventing a child from accessing or contacting the spigot or water control knobs provided in a bathtub.

The general purpose of the present invention, which will be described subsequently in greater detail, is to provide a new Bathtub Safety Guard apparatus and method which has many of the advantages of the safety guards mentioned heretofore and many novel features that result in a new Bathtub Safety Guard which is not anticipated, rendered obvious, suggested, or even implied by any of the prior art safety guards, either alone or in any combination thereof.

To attain this, the present invention generally comprises a first gate section and a second gate section slidably attached to the first gate section, wherein the first and second gate sections each have an upper portion and a lower portion whereby the effective combined width of the first and second gate sections can be varied such that the lower portions fit within the width of a bathtub.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Bathtub Safety Guard apparatus and method which has many of the advantages of the safety guards mentioned heretofore and many novel features that result in a new Bathtub Safety Guard which is not anticipated, rendered obvious, suggested, or even implied by any of the prior art safety guards, either alone or in any combination thereof.

It is another object of the present invention to provide a new Bathtub Safety Guard which may be easily and efficiently manufactured and marketed.

It is a further object of the present invention to provide a new Bathtub Safety Guard which is of a durable and reliable construction.

An even further object of the present invention is to provide a new Bathtub Safety Guard which is susceptible of a low cost of manufacture with regard to both materials and labor, and which accordingly is then susceptible of low prices of sale to the consuming public, thereby making such Bathtub Safety Guard economically available to the buying public.

Still yet another object of the present invention is to provide a new Bathtub Safety Guard which provides in the apparatuses and methods of the prior art some of the advantages thereof, while simultaneously overcoming some of the disadvantages normally associated therewith.

Still another object of the present invention is to provide a new Bathtub Safety Guard for preventing a child from accessing or contacting the spigot or water control knobs provided in a bathtub.

Yet another object of the present invention is to provide a new Bathtub Safety Guard which includes a first gate section and a second gate section slidably attached to the first gate section, wherein the first and second gate sections each have an upper portion and a lower portion whereby the effective combined width of the first and second gate sections can be varied such that the lower portions fit within the width of a bathtub.

Still yet another object of the present invention is to provide a new Bathtub Safety Guard that would prevent a child from accidentally activating the hot water control knob and possibly being scalded.

Even still another object of the present invention is to provide a new Bathtub Safety Guard that would protect a child from bumping into the spigot and water control knobs and becoming injured.

Even still another object of the present invention is to provide a new Bathtub Safety Guard that would prevent a child from accidentally activating the water control knobs and filling the bathtub to a dangerous level which could increase the risk of accidental drowning.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a detailed illustration of area 5 of FIG. 3.

FIG. 6 an illustration of a second embodiment of the present invention.

DESCRIPTION OF THE PREFERRED EMBODIMENT

Figure 2:
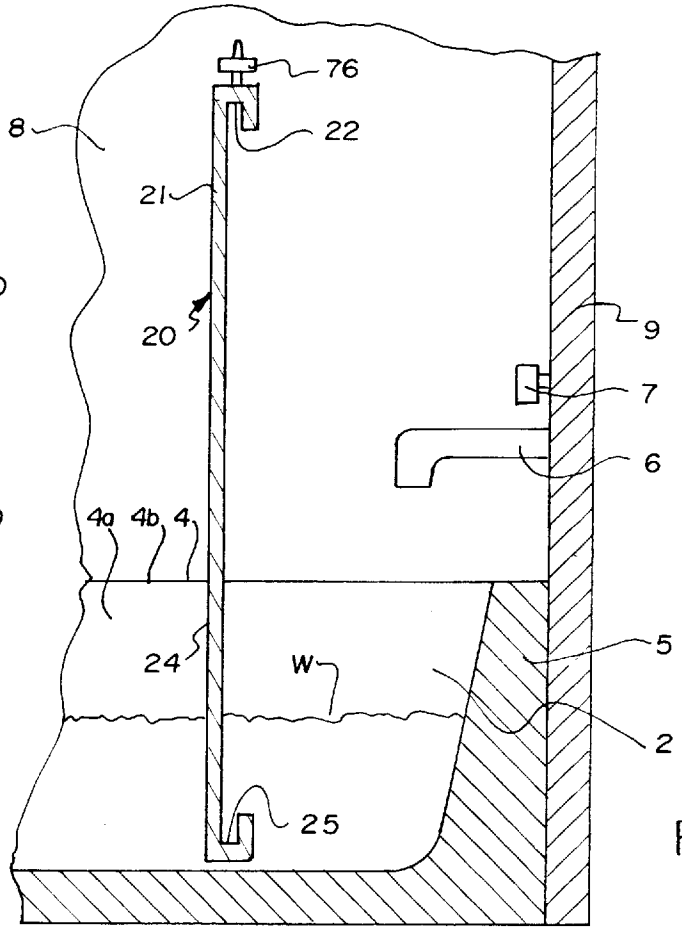
FIG. 2 is a cross sectional view taken along line 2—2 of FIG. 1.

With reference now to the drawings, and in particular to FIGS. 1 through 6 thereof, a new Bathtub Safety Guard embodying the principles and concepts of the present invention and generally designated by the reference numeral 10 will he described.

More specifically, it will be noted that the Bathtub Safety Guard 10 comprises a first gate section 20 and a second gate section 30 slidably attached to the first gate section 20, wherein the first and second gate sections 20 and 30 each have an upper portion 21 and 31 and a lower portion 24 and 34 whereby the effective combined width of the first and second gate sections 20 and 30 can be varied such that the lower portions 21 and 31 fit within the width of a bathtub 2.

The Bathtub Safety Guard 10 is intended for use in a bathtub 2 having an entry side 3, a back side 4, and a forward end 5 wherein a spigot 6 and a water control knob 7 are provided at the forward end 5. The entry side 3 and the back side 4 of the bathtub 2 each have an inner surface 3*a* and 4*a* and a top surface 3*b* and 4*b*. The Bathtub Safety Guard 10 is also intended for use with a back side enclosure wall 8 extending above the back side 4 of the bathtub 2 and a forward end enclosure wall 9 extending above the forward end 5 of the bathtub 2.

Figure 1:
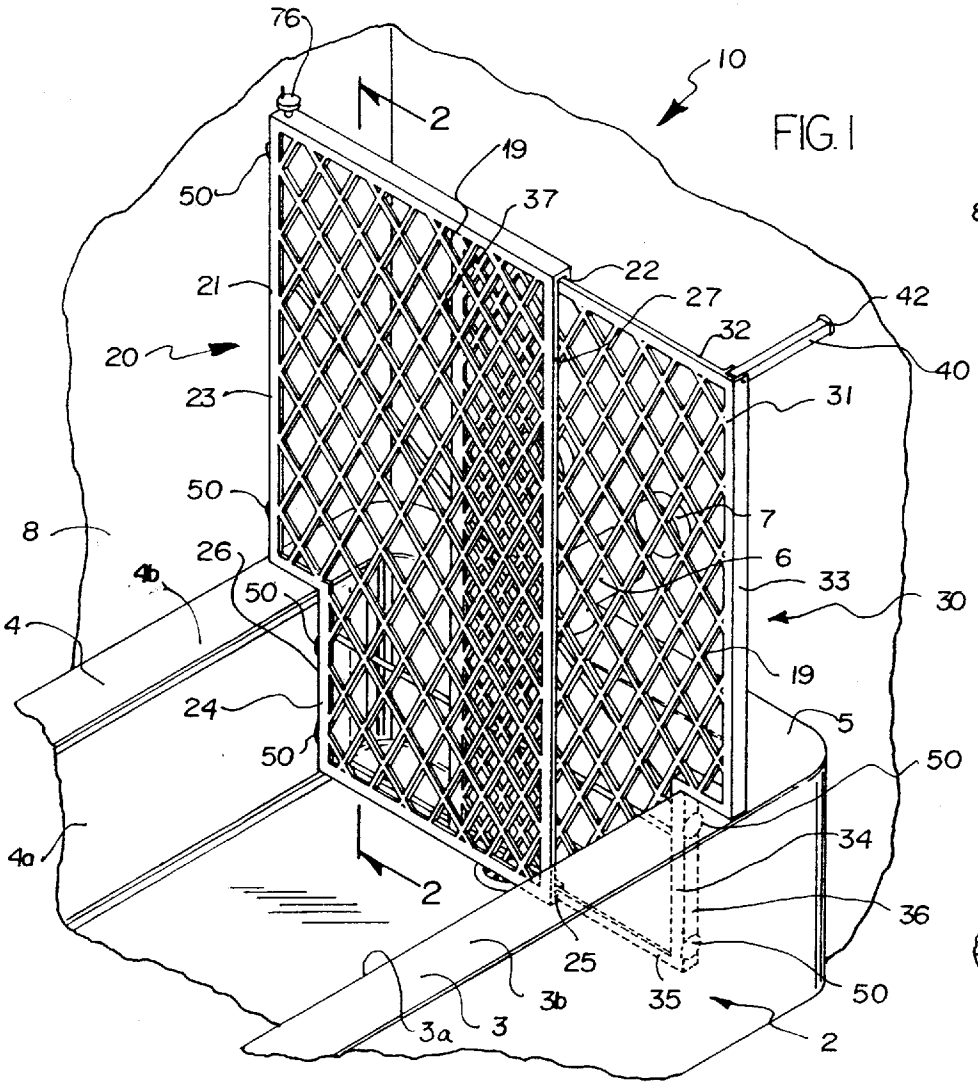
FIG. 1 is an illustration of a new Bathtub Safety Guard installed in a bathtub according to the present invention.
Figure 3:
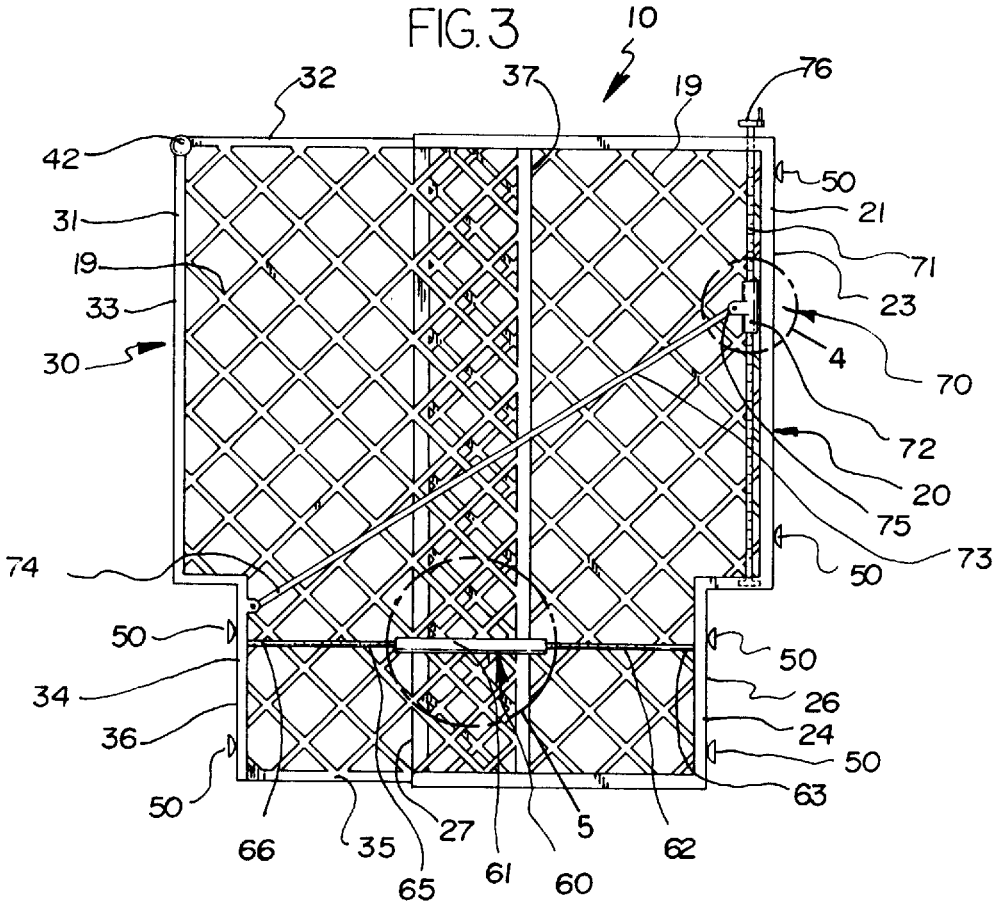
FIG. 3 is a front view of the present invention.

As best illustrated in FIGS. 1 through 3, it can be shown that the first gate section 20 has an upper portion 21 and a lower portion 24. A top channel 22 is provided in the upper portion 21 and a bottom channel 25 is provided in the lower portion 24. The first gate section 20 has an inner side edge 27, an upper portion outer side edge 23, and a lower portion outer side edge 26.

As best illustrated in FIGS. 1 through 3, it can be shown that the second gate section 30 has an upper portion 31 and a lower portion 34. A top rail 32 is provided on the upper portion 31 and a bottom rail 35 is provided on the lower portion 34. The second gate section 30 has an inner side edge 37, an upper portion outer side edge 33, and a lower portion outer side edge 36. The second gate section 30 is slidably attached to the first gate section 20 whereby the top rail 32 fits within the top channel 22 and whereby the bottom rail 35 fits within the bottom channel 25.

As best illustrated in FIGS. 1 and 2, it can be shown that the lower portion 24 of the first gate section 20 and the lower portion 34 of the second gate section 30 fit within the width of the bathtub 2 whereby the lower portion outer side edge 26 of the first gate section 20 and the lower portion outer side edge 36 of the second gate section 30 abut the inner surface 4*a* of the back side 4 of the bathtub 2 and the inner surface 3*a* of the entry side 3 of the bathtub 2, respectively. The upper portion 21 of the first gate section 20 and the upper portion 31 of the second gate section 30 extend over the top surface 4*b* of the back side 4 of the bathtub 2 and the top surface 3*b* of the entry side 3 of the bathtub 2, respectively. The upper portion outer side edge 23 of the first gate section 20 abuts the back side enclosure wall 8. The first gate section 20 and the second gate section 30 are formed of a rigid open-mesh material 19, wherein the open-mesh material 19 allows water W in the bathtub 2 to flow through the first gate section 20 and the second gate section 30.

As best illustrated in FIG. 1, it can be shown that a support arm 40 extends perpendicular from the upper portion 31 of the second gate section 30 toward the forward end enclosure wall 9. The support arm 40 abuts the forward end enclosure wall 9 and provides vertical support for the second gate section 30. A suction cup 42 is provided on the end of the support arm 40 for releasably attaching the support arm 40 to the forward end enclosure wall 9. The support arm 40 may be folded down for storage.

As best illustrated in FIG. 3, it can be shown that a plurality of suction cups 50 are provided on the lower portion outer side edge 26 of the first gate section 20, the lower portion outer side edge 36 of the second gate section 30, and the upper portion outer side edge 23 of the first gate section 20 for releasably attaching the lower portion outer side edge 26 of the first gate section 20 to the inner surface 4*a* of the back side 4 of the bathtub 2, for releasably attaching the lower portion outer side edge 36 of the second gate section 30 to the inner surface 3*a* of the entry side 3 of the bathtub 2, and for releasably attaching the upper portion outer side edge 23 of the first gate section 20 to the back side enclosure wall 8, respectively. A plurality of rubber pads may be used in place of the plurality of suction cups for abutting the lower portion outer side edge 26 of the first gate section 20 against the inner surface 4*a* of the back side 4 of the bathtub 2, for abutting the lower portion outer side edge 36 of the second gate section 30 against the inner surface 3*a* of the entry side 3 of the bathtub 2, and for abutting the upper portion outer side edge 23 of the first gate section 20 against the back side enclosure wall 8. The plurality of suction cups 50 and the plurality of rubber pads may be adjusted toward and away from the outer side edges 23, 26, 33 and 36 to provide a good fit between the outer side edges 23, 26, 33 and 36 of the gate sections 20 and 30, the inner surfaces 3*a* and 4*a* of the bathtub 2, and the back side enclosure wall 8.

As best illustrated in FIGS. 3 and 5, it can be shown that an adjustment means 60 is provided for expanding and contracting the first gate section 20 and the second gate section 30 so that the effective combined width of the first gate section 20 and the second gate section 30 can be varied to fit within the width of the bathtub 2. The adjustment means 60 comprises a turnbuckle 61, a first crossbar 62 having a first end 63 connected to the first gate section 20 and a second end 64 matingly coupled to the turnbuckle 61, and a second crossbar 65 having a first end 66 connected to the second gate section 30 and a second end 67 matingly coupled to the turnbuckle 61. The turnbuckle 61 and the first crossbar 62 and the second crossbar 65 have mating threads whereby rotation of the turnbuckle 61 causes the second end 64 of the first crossbar 62 and the second end 67 of the second crossbar 65 to come together or spread apart.

Figure 4:
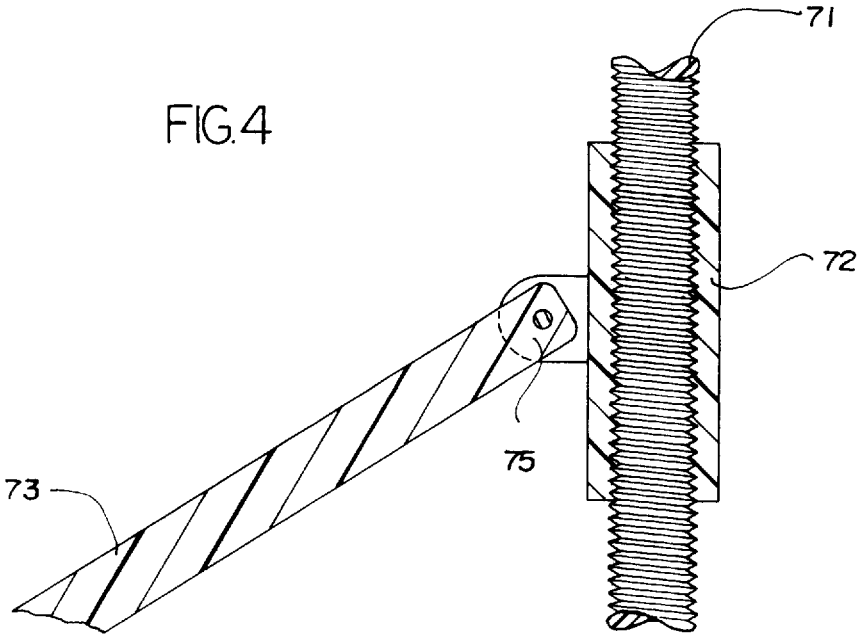
FIG. 4 is a detailed illustration of area 4 of FIG. 3.

As best illustrated in FIGS. 3 and 4, it can be shown that a wedging means 70 is provided for wedging the first gate section 20 and the second gate section 30 within the bathtub 2 and against the back side enclosure wall 8. The wedging means 70 comprises a vertical rod 71 connected to the first gate section 20, a coupling 72 matingly coupled to the vertical rod 71, and a wedging shaft 73 having a first end 74 pivotally connected to the second gate section 30 and a second end 75 pivotally connected to the coupling 72. The coupling 72 and the vertical rod 71 have mating threads whereby rotation of the vertical rod 71 causes the coupling 72 to vertically traverse the vertical rod 71 thereby causing the wedging shaft 73 to wedge the first gate section 20 and the second gate section 30 within the bathtub 2 and against the back side enclosure wall 8. A turn knob 76 is provided at one end of the vertical rod 71 for rotating the vertical rod 71.

As best illustrated in FIG. 6, it can be shown that a second embodiment of the present invention comprises a single gate section 100 having an upper portion 110 and a lower portion 120 wherein the width of the lower portion 120 is such that the lower portion 120 fits within the width of the bathtub 2. The upper portion 110 has a pair of upper portion outer side edges 112 and the lower portion has a pair of lower portion outer side edges 122. The upper portion 110 includes a pair of open side panels 114 which allow access to the water control knob 7 and the spigot 6 from the side. The upper portion 110 extends over the top surface 4*b* of the back side 4 of the bathtub 2 and the top surface 3*b* of the entry side 3 of the bathtub 2.

In use, the Bathtub Safety Guard 10 is positioned in the bathtub 2 and is spaced from the forward end 5 of the bathtub 2. The turnbuckle 61 is adjusted to expand or contract the first gate section 20 and the second gate section 30 so that the effective combined width of the first gate section 20 and the second gate section 30 is slightly less than the width of the bathtub 2. The lower portion outer side edge 26 of the first gate section 20 and the lower portion outer side edge 36 of the second gate section 30 are positioned so as to abut the inner surface 4*a* of the back side 4 of the bathtub 2 and the inner surface 3*a* of the entry side 3 of the bathtub 2, respectively. The upper portion outer side edge 23 of the first gate section 20 is positioned so as to abut the back side enclosure wall 8. The turn knob 76 is rotated to wedge the first gate section 20 and the second gate section 30 within the bathtub 2 and against the back side enclosure wall 8. The support arm 40 is extended so as to abut the forward end enclosure wall 9 and provide vertical support for the second gate section 30. With the Bathtub Safety Guard 10 in place, a child, who is in the bathtub 2, is prevented from accessing and contacting the spigot 6 or the water control knob 7 provided at the forward end 5 of the bathtub 2.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Bathtub Safety Guard for use in a bathtub having an entry side, a back side, and a forward end wherein a spigot and a water control knob are provided at said forward end, said entry side and said back side each having an inner surface and a substantially horizontal top surface, said bathtub further having a back side enclosure wall extending upwardly from said substantially horizontal top surface of said back side, said Bathtub Safety Guard comprising:

a first gate section having an upper portion and a lower portion; and a second gate section having an upper portion and a lower portion, said second gate section slidably attached to said first gate section, said upper portion of said first gate section being wider than said lower portion of said first gate section and being adapted to extend over said top surface of said back side of said bathtub and abut said back side enclosure wall, said upper portion of said second gate section being adapted to extend over said substantially horizontal top surface of said entry side of said bathtub, whereby the effective combined width of said first gate section and said second gate section can be varied such that said lower portion of said first gate section and said lower portion of said second gate section fit within the width of said bathtub.

2. The Bathtub Safety Guard of claim 1, wherein said upper portion of said first gate section includes a top channel and said lower portion of said first gate section includes a bottom channel, and wherein said upper portion of said second gate section includes a top rail and said lower portion of said second gate section includes a bottom rail, said top rail slidingly fitting within said top channel and said bottom rail slidingly fitting within said bottom channel.

3. The Bathtub Safety Guard of claim 1, wherein said first gate section has a lower portion outer side edge, said lower portion outer side edge of said first gate section adapted for abutting said inner surface of said back side of said bathtub, and wherein said second gate section has a lower portion outer side edge, said lower portion outer side edge of said second gate section adapted for abutting said inner surface of said entry side of said bathtub.

4. The Bathtub Safety Guard of claim 3, further comprising a plurality of suction cups provided on said lower portion outer side edge of said first gate section and on said lower portion outer side edge of said second gate section for releasably attaching said lower portion outer side edge of said first gate section to said inner surface of said back side of said bathtub and for releasably attaching said lower portion outer side edge of said second gate section to said inner surface of said entry side of said bathtub.

5. The Bathtub Safety Guard of claim 1, further comprising an adjustment means for expanding and contracting said first gate section and said second gate section so that the effective combined width of said first gate section and said second gate section can be varied to fit within said bathtub.

6. The Bathtub Safety Guard of claim 5, wherein said adjustment means comprises a turnbuckle, a first crossbar having a first end connected to said first gate section and a second end matingly coupled to said turnbuckle, and a second crossbar having a first end connected to said second gate section and a second end matingly coupled to said turnbuckle.

7. The Bathtub Safety Guard of claim 1, further comprising a wedging means for wedging said first gate section and said second gate section within said bathtub.

8. The Bathtub Safety Guard of claim 7, wherein said wedging means comprises a vertical rod connected to said first gate section, a coupling matingly coupled to said vertical rod, and a wedging shaft having a first end pivotally connected to said second gate section and a second end pivotally connected to said coupling, said coupling and said vertical rod having mating threads whereby rotation of said vertical rod causes said coupling to vertically traverse said vertical rod thereby causing said wedging shaft to wedge said first gate section and said second gate section within said bathtub.

9. The Bathtub Safety Guard of claim 8, further comprising a turn knob provided at one end of said vertical rod for rotating said vertical rod.

10. The Bathtub Safety Guard of claim 1, wherein said first gate section and said second gate section are formed of a substantially rigid open-mesh material.

11. A Bathtub Safety Guard for use in a bathtub having an entry side, a back side, and a forward end wherein a spigot and a water control knob are provided at said forward end, said entry side and said back side each having an inner surface and a top substantially horizontal surface, and for use with a back side enclosure wall extending upwardly from said substantially horizontal top surface of said back side of said bathtub and a forward end enclosure wall extending above said forward end of said bathtub, said Bathtub Safety Guard comprising:

a first gate section having an upper portion and a lower portion, said upper portion of said first gate section having an upper portion outer side edge and said lower portion of said first gate section having a lower portion outer side edge, said lower portion outer side edge of said first gate section adapted for abutting said inner surface of said back side of said bathtub and said upper portion outer side edge of said first gate section adapted for extending over said substantially horizontal top surface of back side and abutting said back side enclosure wall, said upper portion of said first gate section being wider than said lower portion of said first gate section; and a second gate section having an upper portion and a lower portion, said second gate section slidably attached to said first gate section, whereby the effective combined width of said first gate section and said second gate section can be varied such that said lower portion of said first gate section and said lower portion of said second gate section fit between said inner surface of said back side of said bathtub and said inner surface of said entry side of said bathtub, said lower portion of said second gate section having a lower portion outer side edge, said lower portion outer side edge of said second gate section adapted for abutting said inner surface of said entry side of said bathtub.

12. The Bathtub Safety Guard of claim 11, wherein said upper portion of said first gate section includes a top channel and said lower portion of said first gate section includes a bottom channel, and wherein said upper portion of said second gate section includes a top rail and said lower portion of said second gate section includes a bottom rail, said top rail slidingly fitting within said top channel and said bottom rail slidingly fitting within said bottom channel.

13. The Bathtub Safety Guard of claim 11, further comprising a support arm extending perpendicularly from said upper portion of said second gate section toward said forward end enclosure wall, said support arm adapted for abutting said forward end enclosure wall.

14. The Bathtub Safety Guard of claim 13, further comprising a support arm suction cup provided at an end of said support arm opposite said upper portion of said second gate section, said support arm suction cup provided for releasably attaching said support arm to said forward end enclosure wall.

15. The Bathtub Safety Guard of claim 11, further comprising a plurality of suction clips provided on said lower portion outer side edge of said first gate section, on said lower portion outer side edge of said second gate section, and on said upper portion outer side edge of said first gate section for releasably attaching said lower portion outer side edge of said first gate section to said inner surface of said back side of said bathtub, for releasably attaching said lower portion outer side edge of said second gate section to said inner surface of said entry side of said bathtub, and for releasably attaching said upper portion outer side edge of said first gate section to said back side enclosure wall.

16. The Bathtub Safety Guard of claim 11, further comprising an adjustment means for expanding and contracting said first gate section and said second gate section so that the effective combined width of said first gate section and said second gate section can be varied to fit within said bathtub.

17. The Bathtub Safety Guard of claim 16, wherein said adjustment means comprises a turnbuckle, a first crossbar having a first end connected to said first gate section and a second end matingly coupled to said turnbuckle, and a second crossbar having a first end connected to said second gate section and a second end matingly coupled to said turnbuckle.

18. The Bathtub Safety Guard of claim 11, further comprising a wedging means for wedging said first gate section and said second gate section within said bathtub and against said back side enclosure wall, said wedging means comprising a vertical rod connected to said first gate section, a coupling matingly coupled to said vertical rod, and a wedging shaft having a first end pivotally connected to said second gate section and a second end pivotally connected to said coupling, said coupling and said vertical rod having mating threads whereby rotation of said vertical rod causes said coupling to vertically traverse said vertical rod thereby causing said wedging shaft to wedge said first gate section and said second gate section within said bathtub and against said back side enclosure wall.

* * * * *